US006200171B1

(12) United States Patent
Fusselman et al.

(10) Patent No.: US 6,200,171 B1
(45) Date of Patent: Mar. 13, 2001

(54) ELECTRICAL CONNECTOR WITH OVER-MOLDED HOUSING MEMBER AND METHOD OF OVER-MOLDING

(75) Inventors: David F. Fusselman, Middletown; Robert D. Gale, Curwenville; David C. Horchler, Millersburg, all of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/451,448

(22) Filed: Nov. 30, 1999

(51) Int. Cl.[7] ..... H01R 13/405
(52) U.S. Cl. ..... 439/736; 29/883
(58) Field of Search ..... 439/736, 79, 80; 29/883, 884

(56) References Cited

U.S. PATENT DOCUMENTS

| | | | | |
|---|---|---|---|---|
| 3,945,708 | | 3/1976 | Griffin . | |
| 4,579,404 | * | 4/1986 | Lockard | 439/736 |
| 4,602,831 | * | 7/1986 | Lockard | 439/736 |
| 4,684,202 | | 8/1987 | House et al. | 439/752 |
| 4,737,117 | * | 4/1988 | Lockard | 439/92 |
| 4,865,562 | | 9/1989 | Burg et al. | 439/395 |
| 5,593,321 | | 1/1997 | Hotea | 439/589 |
| 5,619,012 | | 4/1997 | Casali et al. | 174/52.2 |
| 5,647,751 | | 7/1997 | Shulman et al. | 439/106 |
| 5,722,861 | * | 3/1998 | Wetter | 439/701 |
| 5,779,505 | | 7/1998 | Yagi et al. | 439/736 |
| 5,795,191 | | 8/1998 | Preputnick et al. | 439/608 |
| 5,902,136 | | 5/1999 | Lemke et al. | 439/74 |
| 5,926,952 | * | 7/1999 | Ito | 29/883 |
| 6,007,387 | * | 12/1999 | Uchiyama | 439/736 |
| 6,033,258 | * | 3/2000 | Huang et al. | 439/79 |
| 6,041,498 | * | 3/2000 | Hillbish et al. | 29/883 |

OTHER PUBLICATIONS 6 page Product Datasheet, Berg Electronics, Apr. 9, 1997.

* cited by examiner

*Primary Examiner*—Khiem Nguyen
*Assistant Examiner*—Hae Moon Hyeon
(74) *Attorney, Agent, or Firm*—Perman & Green, LLP

(57) ABSTRACT

An electrical connector comprising an electrical contact; and a housing. The housing comprises a first member and a second member. The first member comprises a contact receiving channel. The second member is over-molded onto the first member. The electrical contact is located in the channel and retained on the housing by a capture of the contact between the first and second members. The first member and the contact extend past a first end of the capture of the contact between the first and second members.

18 Claims, 6 Drawing Sheets

FIG. 1
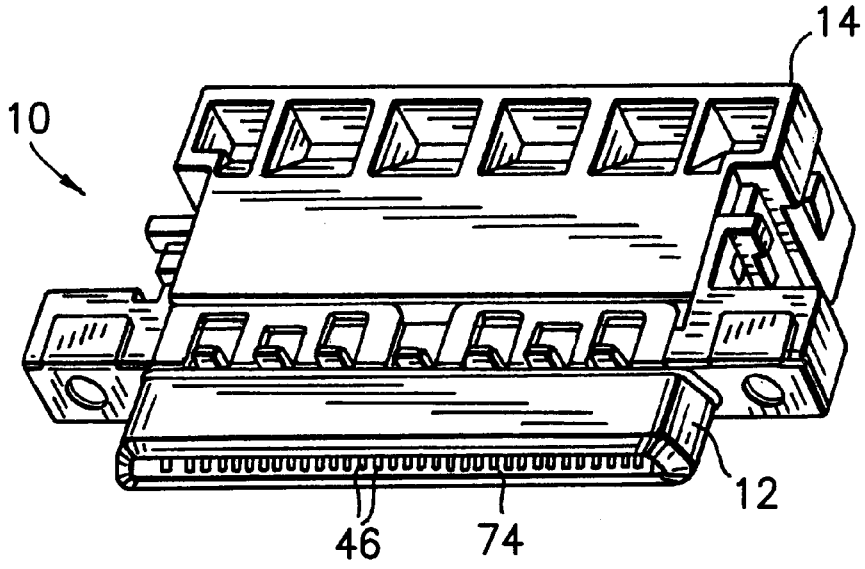
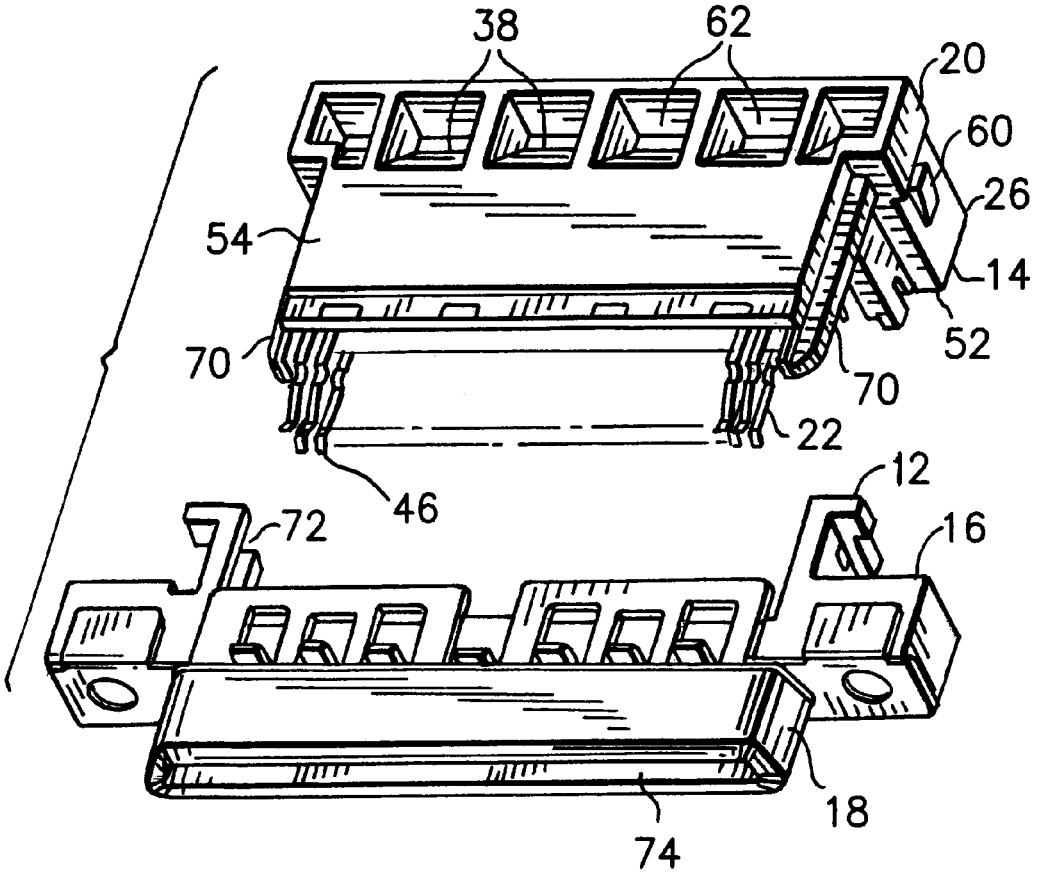
FIG. 2

FIG.3B
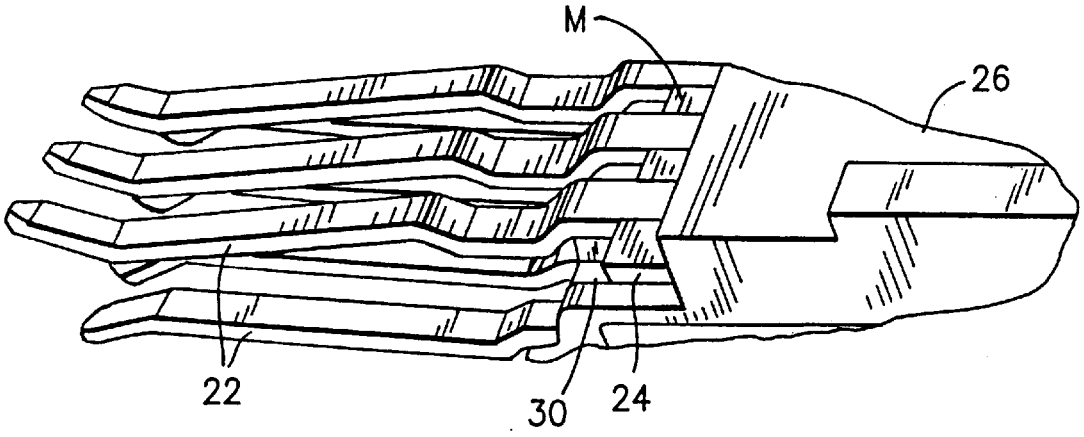
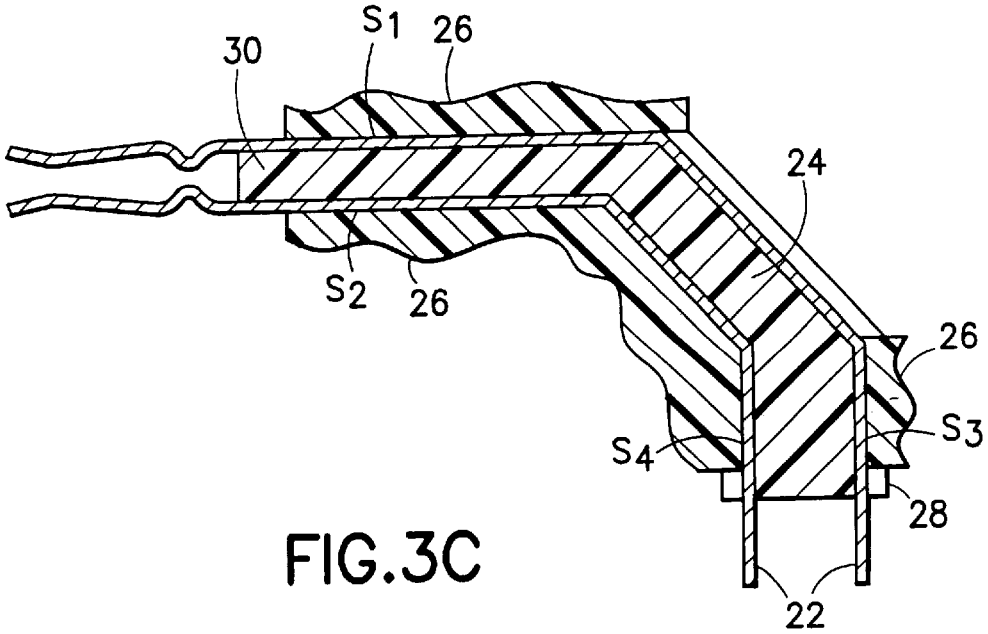
FIG.3C

FIG.6
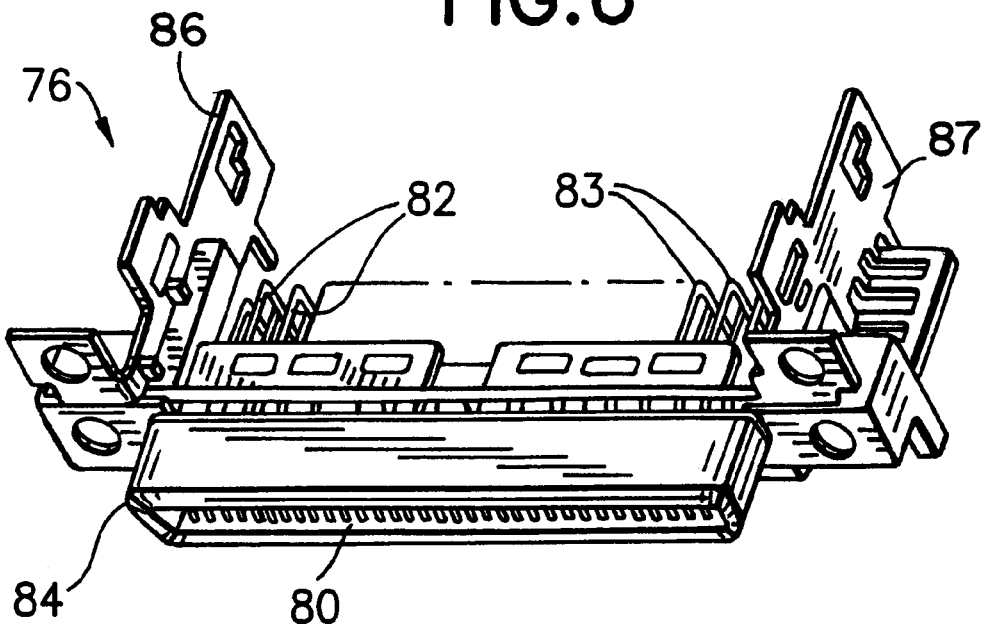
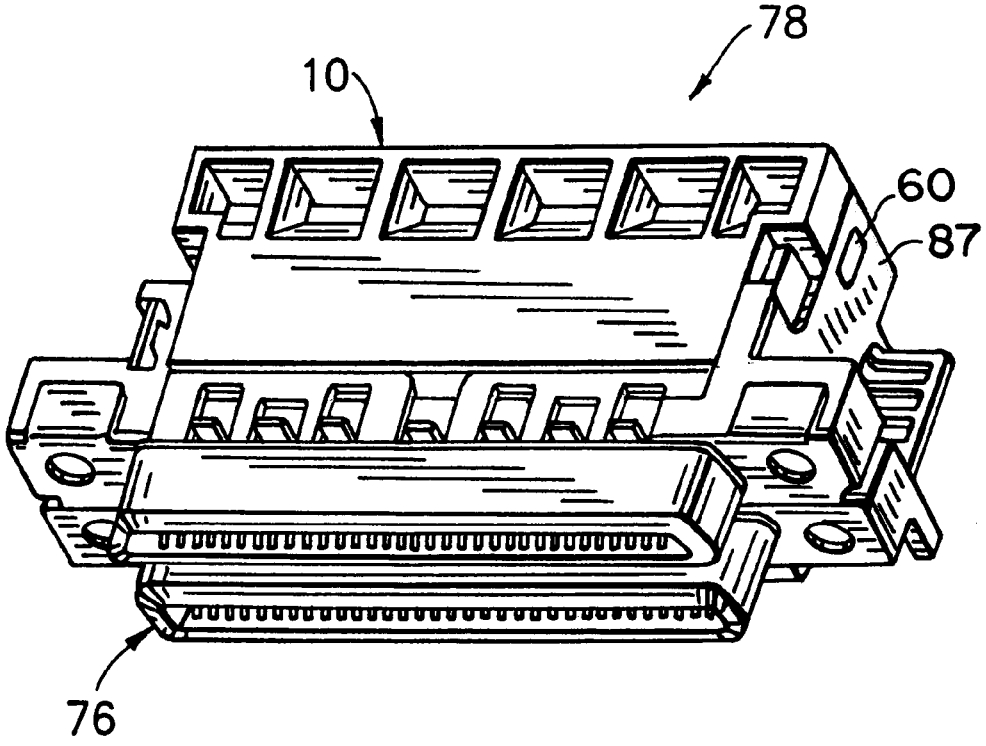
FIG.7

ELECTRICAL CONNECTOR WITH OVER-MOLDED HOUSING MEMBER AND METHOD OF OVER-MOLDING

BACKGROUND OF THE INVENTION

1. Field of the Invention

The present invention relates to electrical connectors and, more particularly, to a connector with an over-molded housing member.

2. Brief Description of Earlier Developments

U.S. Pat. No. 3,945,708 discloses an electrical connector with a premold and a molded cover. U.S. Pat. No. 4,865,562 discloses molding a strip onto contacts. Berg Electronics sells a right angle receptacle electrical connector known as the VHDCI. The housing of the connector is a multi-piece housing which must be carefully assembled with the electrical contacts to prevent damage to the contacts and, must still form a rigid holding of the contacts between housing pieces. A need exists for manufacturing a right angle receptacle connector that is easier and less expensive to manufacture. For connectors having contact ends at relatively small spacings or pitch, such as 0.4 mm or less, precision or tolerances must be very precise. Because of this, over-molding of housing components was not used. This is because contact ends could be disturbed by over-molding thereby preventing proper connection to other components. For example, the contact ends could be misaligned because of over-molding such that they are not easily inserted into an array of holes in a printed circuit board. As another example, the opposing contact ends on opposite sides of rows could be positioned too close to each other, thereby blocking an insertion path into a receiving area between the rows and possibly causing stubbing, or could be positioned too far away from each other, thereby preventing proper wiping, normal force or connection with a mating connector. It would be desirable to use over-molding of a housing component if these problems could be overcome.

SUMMARY OF THE INVENTION

In accordance with one embodiment of the present invention, an electrical connector is provided comprising an electrical contact; and a housing. The housing comprises a first member and a second member. The first member comprises a contact receiving channel. The second member is over-molded onto the first member. The electrical contact is located in the channel and retained on the housing by a capture of the contact between the first and second members. The first member and the contact extend past a first end of the capture of the contact between the first and second members.

In accordance with another embodiment of the present invention, an electrical connector is provided comprising electrical contacts and a housing connected to the electrical contacts. The housing comprises a first member and a second member over-molded onto the first member. The first member comprises first elongate contact receiving channels with open elongate sides along a first exterior side of the first member. The electrical contacts are inserted into the channels at the exterior side of the first member through the open sides of the channels and the over-molded second member covers the electrical contacts along a majority of the open sides of the channels. The first member supports three sides of the electrical contacts in the channels.

In accordance with one method of the present invention, a method of manufacturing an electrical connector is provided comprising steps of providing a first housing member with a first contact receiving channel; inserting a first electrical contact into the contact receiving channel, a portion of the contact extending out of the first housing member at a first end of the first housing member; and over-molding a second housing member onto the first housing member, wherein the first housing member forms a first seal with an over-molding die at the first end of the first housing member during the step of overmolding to prevent material which forms the second housing member from contacting the portion of the contact located past the end of the first housing member to prevent the portion from being deformed during the step of over-molding.

BRIEF DESCRIPTION OF THE DRAWINGS

The foregoing aspects and other features of the present invention are explained in the following description, taken in connection with the accompanying drawings wherein:

FIG. 1 is a perspective view of an electrical connector incorporating features of the present invention;

FIG. 2 is an exploded view of the connector shown in FIG. 1;

FIG. 3B is an enlarged view of area 3B shown in FIG. 3;

FIG. 3C is a schematic partial cross-sectional view of the subassembly shown in FIG. 3;

FIG. 6 is a perspective view of a second lower subassembly electrical connector for attachment to the connector shown in FIG. 1; and FIG. 7 is a perspective view of the two electrical connectors shown in FIGS. 1 and 6 connected to each other to form a double deck, right angle receptacle electrical connector.

DETAILED DESCRIPTION OF THE PREFERRED EMBODIMENT

Figure 3:
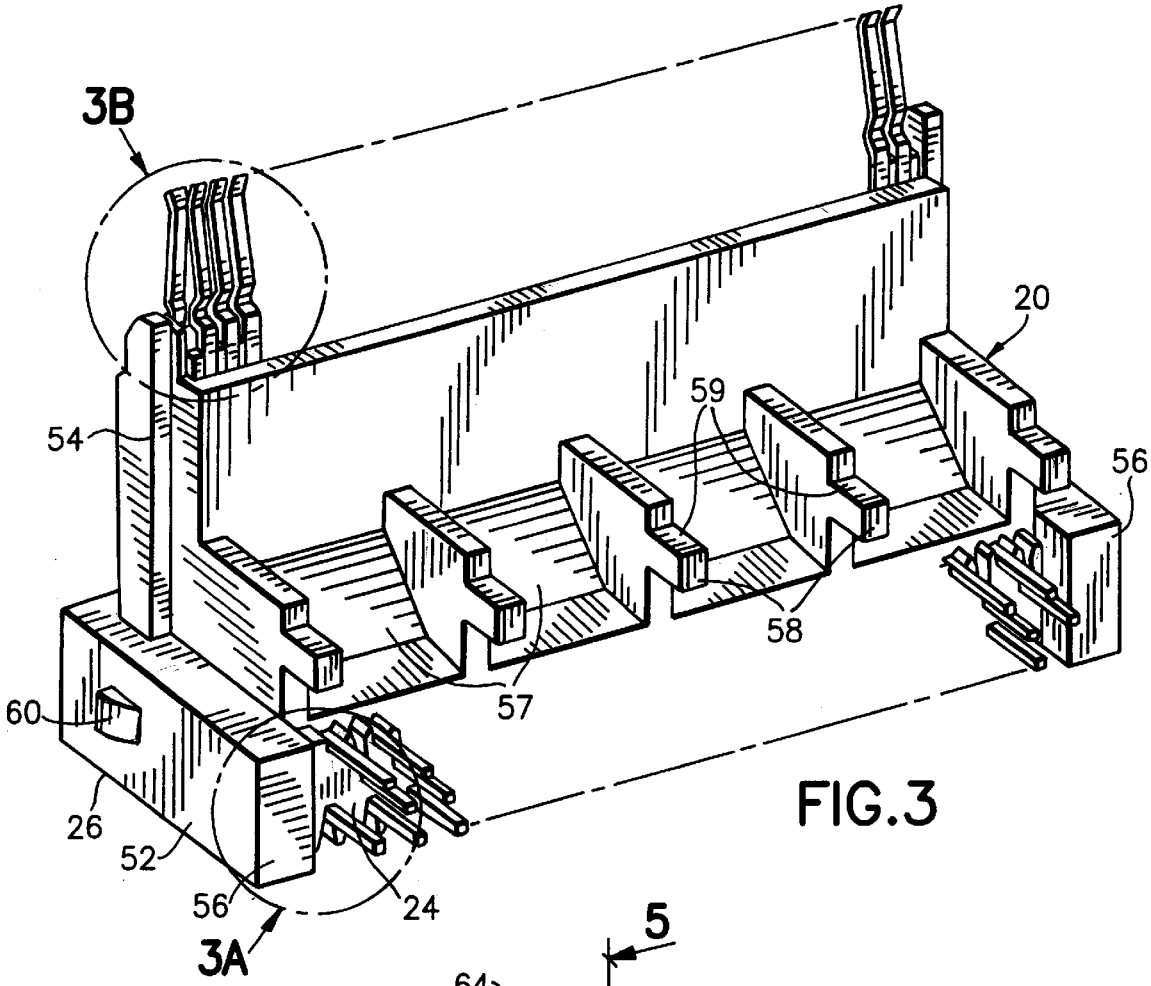
FIG. 3 is a perspective view of one of the subassemblies shown in FIG. 2.

Referring to FIG. 1, there is shown a perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Referring also to FIG. 2, the connector 10 generally comprises two subassemblies 12, 14. The first subassembly 12 generally comprises an outer housing piece 16 and an extended shield shell 18. The second subassembly 14 generally comprises a housing 20 and electrical contacts 22. Referring a also to FIGS. 3, 3A, 3B and 4, the housing 20 generally comprises a first member 24 and a second member 26. As seen best in FIG. 4, the first member 24 generally comprises a one-piece molded plastic member. However, in alternate embodiments the first member could be comprised of any suitable material or combination of materials and, could be comprised of multiple pieces. The first member 24 has a general right turn shape wherein a first end 28 is offset about 90° from a second end 30. However, the first member 24 could have any suitable shape including being straight, such as for a vertical electrical connector rather than a right angle connector. In the embodiment shown in FIG. 4 the first member 24 comprises three sections 32, 33, 34 angled relative to each other in series, such as at 45° angles. Thus, the first member 24 forms an inner side 36 and an outer side 38. First member 24 acts as a comb for locating the contacts 22. The first member 24 includes contact receiving channels or grooves 40, 42, extending into the first member along the two sides 36, 38 and along all three sections 32, 33, 34. As seen best in FIG. 3A, the channels 40, 42 preferably have a general V shape and alternatingly vary in depth along each side 36, 38 at the section 32. Thus, adjacent channels 40*a* and 40*b*, at section 32 have different depths into the first member. Adjacent channels 42*a* and 42*b* at section 32 also have different depths. However, the channels 40*a*, 40*b* and 42*a*, 42*b* have the same depth at the opposite section 34. Preferably, the transition in depth occurs at a junction with or along the middle section 33. However, any suitable depths and/or transitions in depth of the channels could be provided. In addition, in an alternate embodiment, the first member 24 might only have one side 36 or 38 with the contact receiving channels. The contacts 22 are placed within grooves 40, 42 as described in more detail below.

The contacts 22 are generally stamped and formed from a sheet of suitable conductive material, such as a copper alloy, but any suitable process and/or materials could be used to form the contacts. The contacts 22 each comprise a first connection or mounting section 44, an opposite second connection or mounting section 46, and a middle section 48 therebetween. In this embodiment the first connection sections 44 are provided as through-hole solder tails intended to be inserted into holes in a printed circuit board (not shown) and soldered thereto. However, the first connection section 44 could have any suitable shape, such as a spring contact or a surface mount solder tail. The middle sections 48 are located in the channels 40, 42. In a preferred embodiment the contacts 22 have retainment barbs (not shown) to at least temporarily attach the contacts 22 to the first member 24 in the channels 40, 42. The second connection sections 46 are provided as two rows of spring contact beam sections forming a receiving area 50 therebetween for removably receiving a portion of a mating electrical connector (not shown).

The second member 26 of the housing 20 is molded onto or over the first member 24 with contacts 22 inserted therein. In this embodiment the second housing member 26 generally comprises a first section 52, and a second section 54. The first section 52 generally comprises supports 56, 58, side latches 60, and recesses 62. The supports 56, 58 are provided to help stabilize mounting of the housing 20 on a surface of a printed circuit board or other electronic component. The recesses 62 are merely provided to save material and make the connector light weight. The first section 52 surrounds the first member 24 at the first and middle sections 32, 33 except at the end 28. In a preferred embodiment the outer side 38 at the middle section 33 is also not covered by the material of the second member 26; merely because of the first member 24 being contacted at that location by a mold used during forming of the second member 26. The second section 54 generally surrounds the front section 34 of the first member 24 except at the end 30.

Figure 3A:
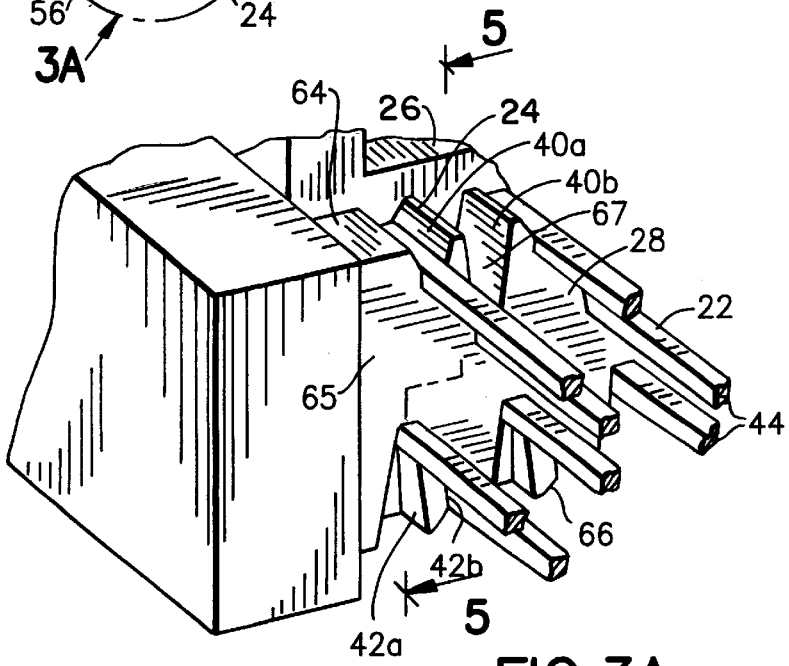
FIG. 3A is an enlarged view of area 3A shown in FIG. 3.
Figure 4:
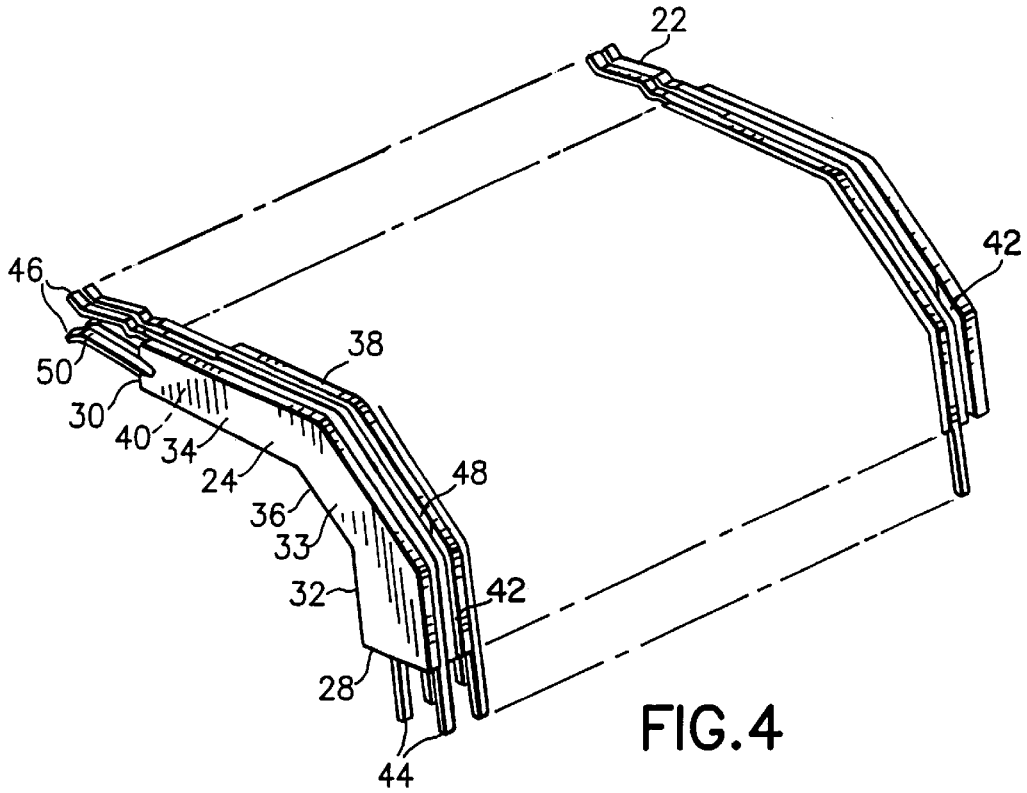
FIG. 4 is a perspective view of a contact fixture block subassembly used to manufacture the component shown in FIG. 3.
Figure 5:
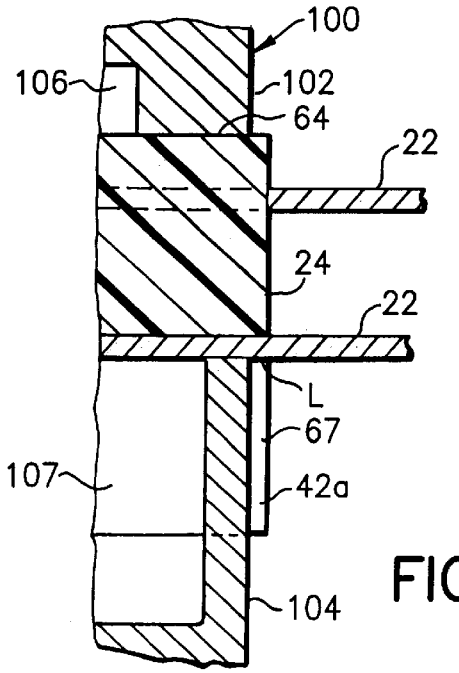
FIG. 5 is a partial cross-sectional view of the subassembly shown in FIG. 4 inside a mold being used to form the over-molded housing piece over the subassembly.
Figure 5A:
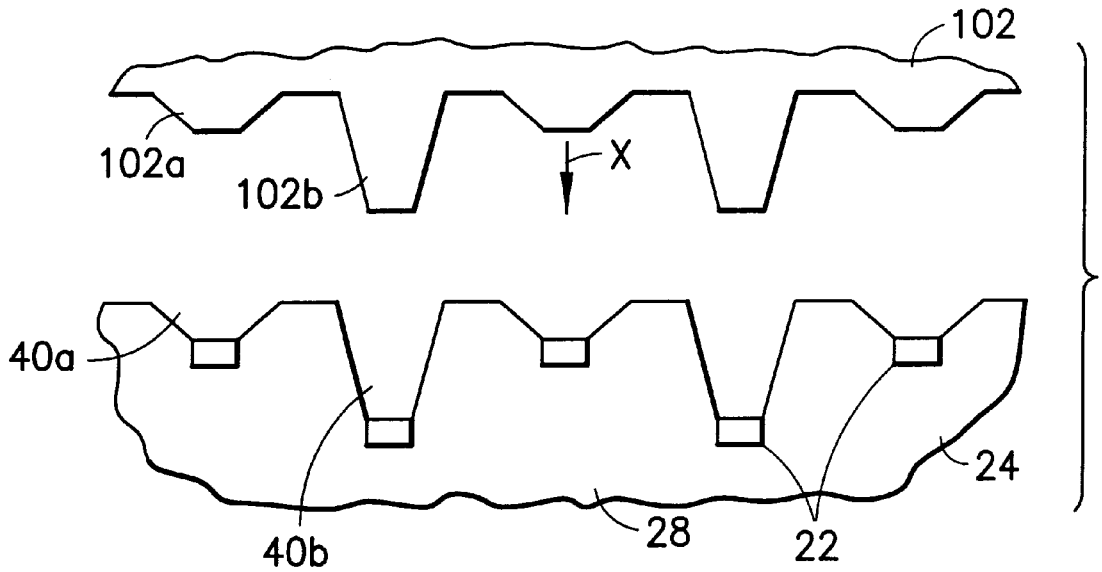
FIG. 5A is a partial elevational view of a first end of the first member and electrical contacts and one of the dies shown in FIG. 5.
Figure 5B:
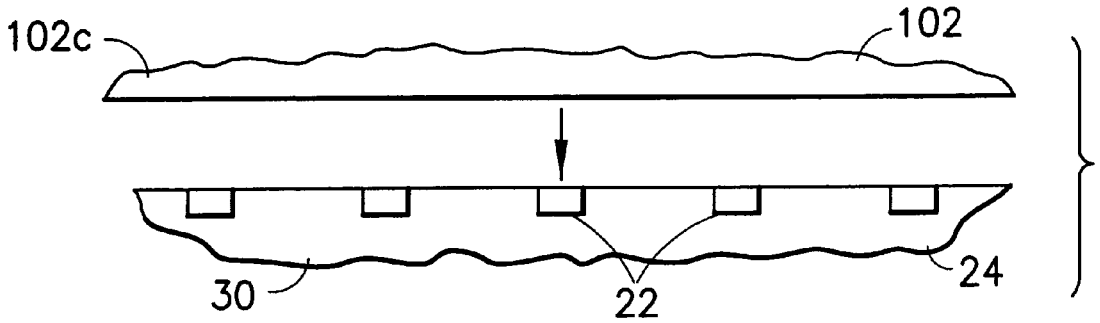
FIG. 5B is a partial elevational view of an opposite second end of the first member and electrical contacts and one of the dies shown in FIG. 5.

As noted above, the second member 26 is molded onto the first member 24. More specifically, after the contacts 22 are inserted into the channels 40, 42, the assembly is inserted into a mold and the second member 26 is formed by injecting plastic into the mold and onto the first member 24. As seen in FIG. 5, the molding apparatus 100 includes dies 102, 104 that clamp onto portions of the first member 24. This forms open areas, such as areas 106, 107, in which plastic material can be injection molded to form the second member 26. The dies 102, 104 contact the first member 24 at specific locations and also contact the contacts 22 at specific locations. Referring particularly to FIGS. 5 and 3A, the dies 102, 104 contact the surfaces 64, 65, 66 in the outside of the end 28 and surfaces 67 inside channels 40, 42 at the end 28. The first member 24 is used to form a seal with the dies 102, 104 at these locations to prevent the material which is being used to form the second member 26 from being injected near the location L where the contacts exit the channels 40, 42 at the end 28. For example, as seen in FIG. 5A, the die 102 can have two types of projections 102*a*, 102*b* which are sized and shaped to fit inside respective ones of the channels 40*a*, 40*b* when the die 102 is moved into contact with the first member 24 as illustrated by arrow X. The die 104 can have projections similar to projections 102*a*, 102*b* which are sized and shaped to fit inside respective ones of the channels 42*a*, 42*b*, proximate, but slight spaced from the end 28. Likewise, as seen with references to FIG. 3B, the first member 24 is used to form a seal with the dies at the front end 30 to prevent the material which is being used to form the second member 26 from being injected near the location M where the contacts 22 exit the channels 40, 42 at the end 30. As seen in FIG. 5B, the die 102 can have an appropirate shaped section 102*c* for contacting the tops of the contacts 22 and the first member 24 proximate the end 30. The die 104 can have a similar section. Thus, after the second member 26 is molded, the ends 28, 30 of the first member 24 extend out of the second member 26. With the present invention, use of the first member 24 as a seal with the molding apparatus prevents the ends 44, 46 of the contacts from being substantially disturbed during the process of molding the second member 26 onto the first member 24. Without this sealing function, the contact ends 44, 46 could be disturbed thereby preventing proper connection to other components. For example, the ends 44 could be misaligned such that they are not easily inserted into an array of holes in a printed circuit board. As another example, the ends 46 on opposite sides of the rows could be positioned too close to each other, thereby blocking an insertion path into area 50 and possibly causing stubbing, or could be positioned too far away from each other, thereby preventing proper wiping, normal force or connection with a mating connector. For connectors having contact ends at relatively small spacings or pitch, such as 0.4 mm or less, precision or tolerances must be very precise. By preventing the molding of the second member 26 from effecting the spacing of the contacts' ends 44, 46 the present invention allows overmolding to be used for a housing part (that contacts the contacts) in connectors having contacts with small contact pitch; which was previously unavailable. The over-molded housing piece 26 also cooperates with the fixture piece 24 to capture or sandwich portions of the contacts 22 therebetween to permanently fix the contacts in the housing 20 at ends 28, 30 of the first member 24 at capture locations $S_1$, $S_2$, $S_3$ and $S_4$ as shown in FIG. 3C.

Referring back to FIGS. 1 and 2, the second subassembly 14 has rails 70 along the lateral sides of the second section 54. The first subassembly 12 has slots 72 to receive the rails 70. The front ends 46 of the contacts and the front end 30 of the first member 24 are inserted into a main receiving slot 74 of the outer housing piece 16 with the two subassemblies 12, 14 latching to each other to form the connector 10. However, any suitable means could be used to connect the two subassemblies 12, 14 to each other.

Referring to FIGS. 1, 6 and 7, the connector 10 can be used with a second connector 76 to form a dual or double deck connector 78. The second connector 76, in this embodiment, is also a right angle connector and generally comprises a housing 80, electrical contacts 82, and a shield shell 84. The surfaces 59 (see FIG. 3) can abut against the rear end of the housing 80 to help position the two connectors 10, 76 relative to each other. Center sections 83 of the contacts 82 can also extend in areas 57 (see FIG. 3). The shield shell 84 is connected to the housing 80 and includes side connector sections 86, 87 for connection to the latches 60 of the first connector 10. This new connector 78 forms a double deck electrical connector.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

an electrical contact; and a housing comprising a first member and a second member, the first member comprising a contact receiving channel, the second member being over-molded onto the first member, wherein the electrical contact is located in the channel and is retained on the housing by capturing the contact between the first and second members at a capture location, wherein the first member and the contact extend past a first end of the capture location, and wherein the contact is not captured between the first and second members past the first end of the capture location.

2. A connector as in claim 1 wherein the contact receiving channel extends along a first exterior side of the first member.

3. A connector as in claim 2 wherein the first member further comprises a plurality of additional contact receiving channels extending along the first exterior side of the first member.

4. A connector as in claim 2 wherein the first member further comprises at least one additional contact receiving channel extending along a second opposite exterior side of the first member.

5. A connector as in claim 1 wherein the contact comprises a first end which extends past a first end of the first member and a second end which extends past a second end of the first member.

6. A connector as in claim 5 wherein the first and second ends of the contact respectively comprise a spring contact section and a through-hole mounting section.

7. A connector as in claim 1 wherein the first member and the electrical contact have a general right turn shape.

8. A connector as in claim 1 wherein the first member and the contact extend past a second end of the capture location of the contact between the first and second members.

9. A connector as in claim 1 wherein the contact receiving channel contacts three sides of the electrical contact and the second member is over-molded partially into the contact receiving channel to contact a fourth side of the contact.

10. An electrical connector comprising:

electrical contacts; and a housing connected to the electrical contacts, the housing comprising a first member and a second member over-molded onto the first member, wherein the first member comprises first elongate contact receiving channels with open elongate sides along a first exterior side of the first member, wherein the electrical contacts are inserted into the channels at the exterior side of the first member through the open sides of the channels and the over-molded second member contacts the electrical contacts, and the second member covers the electrical contacts along a majority of the open sides of the channels, wherein the first member supports three sides of the electrical contacts in the channels, and wherein the over-molded second member does not cover a first portion of the first exterior side of the first member at a first end of the first member where the contacts project out from the first end of the first member.

11. A connector as in claim 10 wherein the over-molded second member does not cover a portion of the contacts along the first exterior side of the first member at first ends of the channels located at the first end of the first member.

12. A connector as in claim 11 wherein the over-molded second member does not cover a second portion of the first exterior side of the first member at a second end of the first member where the contacts project out from the second end of the first member.

13. A connector as in claim 12 wherein the over-molded second member does not cover a portion of the contacts along the first exterior side of the first member at second ends of the channels located at the second end of the first member.

14. A connector as in claim 10 wherein the first member further comprises second elongate contact receiving channels along a second exterior side of the first member with at least some of the electrical contacts located in the second channels and the over-molded second member partially covering the contacts in the second channels.

15. A method of manufacturing an electrical connector comprising steps of:

providing a first housing member with a first contact receiving channel;

inserting a first electrical contact into the contact receiving channel, a portion of the contact extending out of the first housing member at a first end of the first housing member; and over-molding a second housing member directly onto the first housing member and directly onto the first electrical contact, wherein an over-molding die forms a first seal with the first housing member and the first electrical contact at the first end of the first housing member during the step of over-molding to prevent material which forms the second housing member from contacting the portion of the contact located past the end of the first housing member to prevent the portion from being deformed during the step of over-molding.

16. A method as in claim 15 wherein the first housing member comprises an exterior side with the contact receiving channel therealong between the first end and a second end of the first housing member, wherein the first seal is formed at the exterior side of the first housing member at the first end.

17. A method as in claim 16 wherein the first housing member forms a second seal with the over-molding die at the second end of the first housing member along a portion of the exterior side of the first housing member.

18. A method as in claim 15 wherein the first housing member further comprises a second contact receiving channel along an exterior side of the first housing member different from the first contact receiving channel, further comprising inserting a second electrical contact into the second channel, and wherein the step of over-molding forms the second housing member along only a portion of the exterior side of the first housing member covering only a portion of the second contact in the second contact receiving channel.

* * * * *